United States Patent [19]

Ferns

[11] Patent Number: 4,508,470

[45] Date of Patent: Apr. 2, 1985

[54] MANHOLE/ACCESS COVER AND FRAME ASSEMBLIES

[75] Inventor: Derek Ferns, Monmouth, Wales

[73] Assignee: Selflevel Covers (Jersey) Limited, Jersey, Channel Islands

[21] Appl. No.: 459,096

[22] Filed: Jan. 19, 1983

[30] Foreign Application Priority Data

Jan. 20, 1982 [GB] United Kingdom ..... 8201582

[51] Int. Cl.[3] ..... E02D 29/14

[52] U.S. Cl. ..... 404/25; 404/3; 52/19

[58] Field of Search ..... 404/25, 2, 3, 4, 5, 404/8; 52/19, 20, 21, 254, 255, 256, 257, 601

[56] References Cited

U.S. PATENT DOCUMENTS 999,752 8/1911 Connell ..... 52/241

3,217,619 11/1965 Driver et al. ..... 404/25

FOREIGN PATENT DOCUMENTS 2313594 11/1973 Fed. Rep. of Germany ..... 52/19

2429470 1/1976 Fed. Rep. of Germany ..... 404/25

2013301 8/1979 United Kingdom ..... 52/19

*Primary Examiner*—Stephen J. Novosad

*Assistant Examiner*—Mark J. DelSignore

*Attorney, Agent, or Firm*—Young & Thompson

[57] ABSTRACT

A frame, for a manhole/access cover and frame assembly, has outer peripheral portions which are generally of inverted U-shape in cross-section, and the outer surfaces of the peripheral portions, forming the outer limb of the inverted U, are formed with a plurality of apertures or cut-outs to facilitate the flow of concrete into the space within the peripheral portions to bed the frame securely into the concrete.

4 Claims, 5 Drawing Figures

MANHOLE/ACCESS COVER AND FRAME ASSEMBLIES

BACKGROUND OF THE INVENTION

The invention relates to manhole/access cover and frame assemblies. The invention is particularly applicable to assemblies where both the cover and frame are formed from cast iron, but it is not limited to such assemblies.

The frames of such assemblies are usually bedded in concrete or other road surfacing material, and to retain the cover in position within the road surfacing material it may be formed with a peripheral flange which projects outwardly from the lower part of the frame. The road surfacing material then bears down on the flange, and inwardly on the periphery of the frame, to hold the frame in position. It is found in practice, however, that such an arrangement may not hold the frame sufficiently securely in locations where the assembly is subjected to very heavy loads from traffic. The present invention therefore sets out to provide an improved form of frame which will be more strongly held in position by the road surfacing material.

SUMMARY OF THE INVENTION

According to the invention there is provided a frame, for a manhole/access cover and frame assembly, having outer peripheral portions which are generally of inverted U-shape in cross-section.

With this configuration, when the frame is being concreted in position, the concrete may be pressed into the inverted U-section of the frame so as to strengthen the whole frame structure from the underside. To facilitate introduction of the concrete into the frame the outer surfaces of the peripheral portions, forming the outer limb of the inverted U, are preferably formed with a plurality of apertures and/or cut-outs to facilitate the flow of concrete into the space within the peripheral portions. The apertures and/or cut-outs preferably constitute a major portion of the area of the outwardly facing parts of the peripheral portions so that, in effect, the outwardly facing parts of the peripheral portions, between the apertures and/or cut-outs, form tangs which act as holding down lugs for the frame.

The lower edge of the inner limb of the inverted U-section may be formed with an inwardly projecting, substantially horizontal flange.

In any of the above arrangements the frame of the assembly may comprise a number of separately formed frame members secured together. Such an arrangement is particularly suitable for large rectangular frames supporting a plurality of covers. For smaller assemblies, such as circular manhole assemblies, the frame may be integrally formed in one piece.

DETAILED DESCRIPTION OF THE PREFERRED EMBODIMENTS

Figure 1:
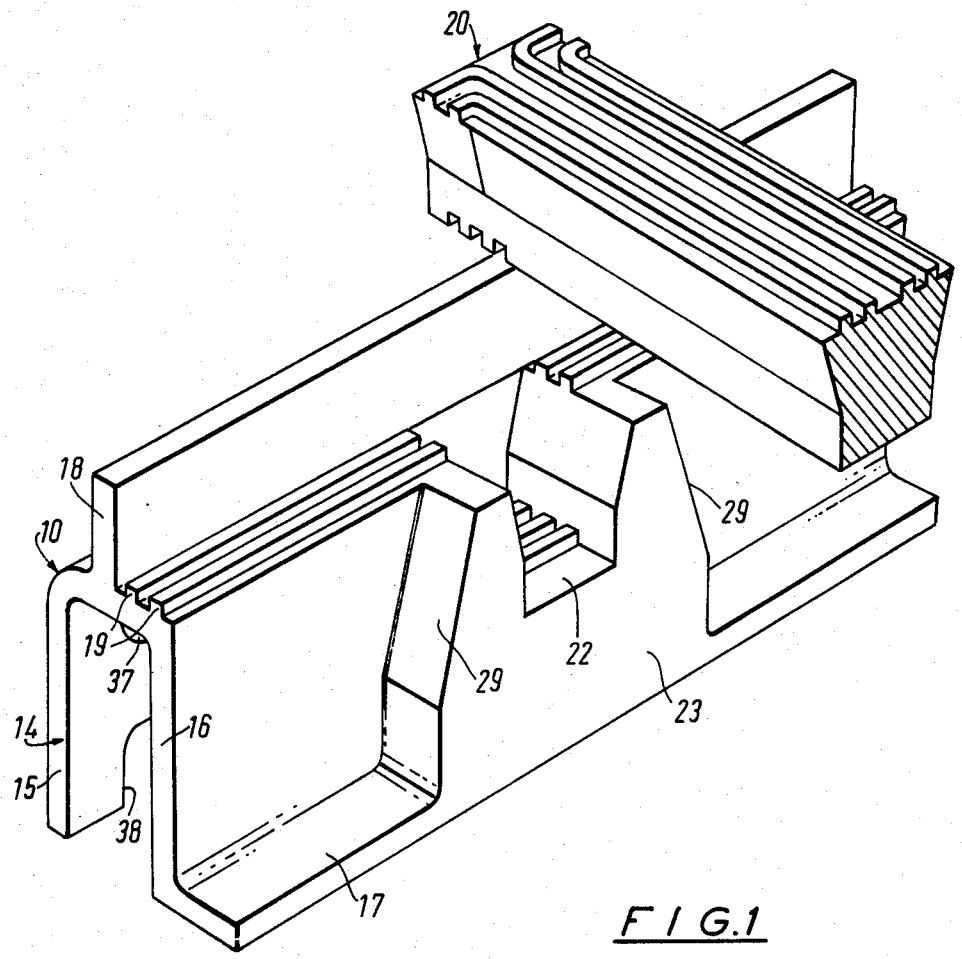
FIG. 1 is a perspective view of part of the frame of a rectangular cover and frame assembly.
Figure 2:
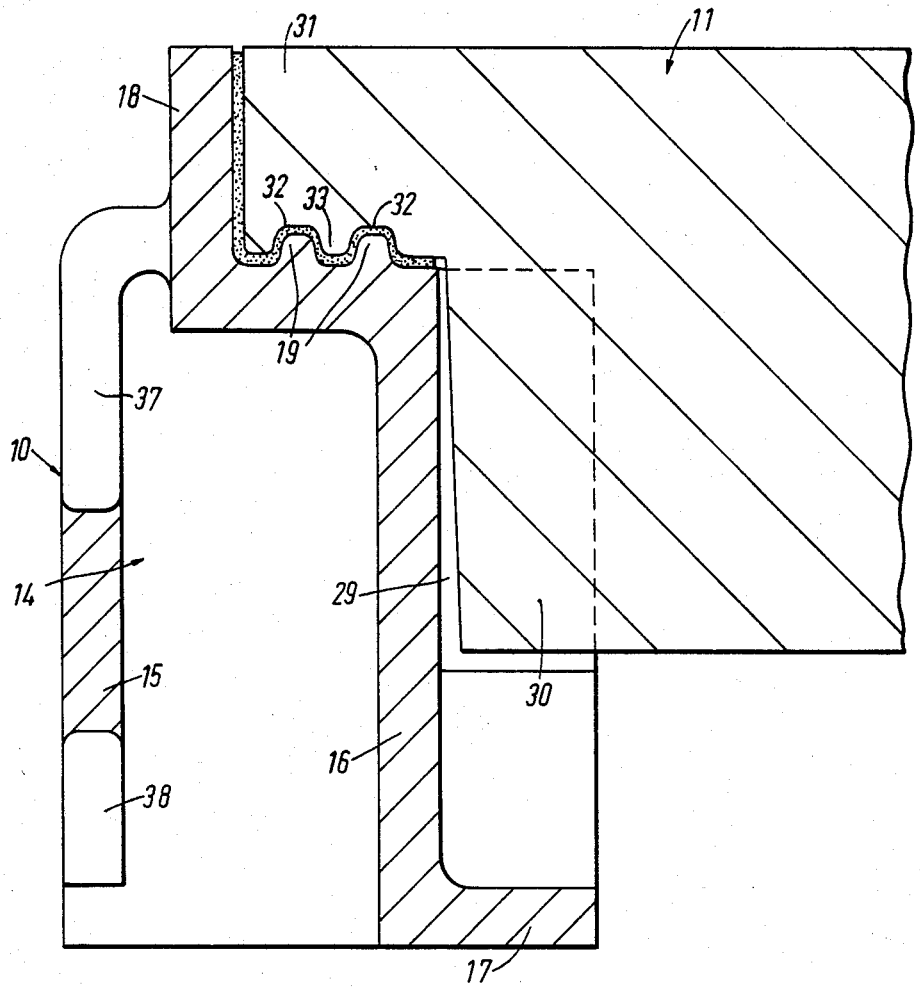
FIG. 2 is a vertical section through one side member of a frame and part of a cover supported thereon.
Figure 3:
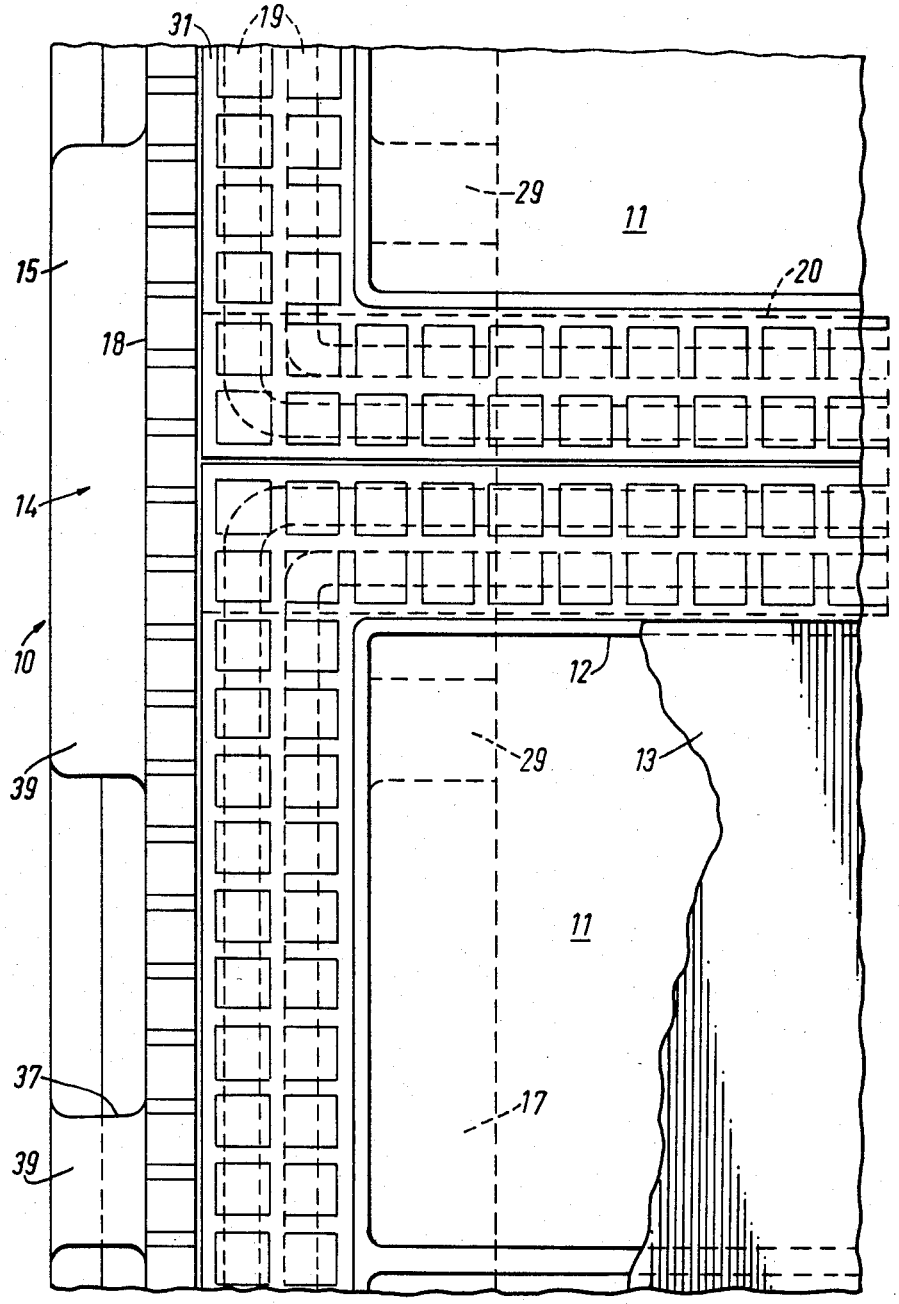
FIG. 3 is a plan view of part of an assembled cover and frame assembly in which a number of covers are supported on a single frame.

Referring to FIGS. 1 to 3 of the drawings, a manhole cover and frame assembly comprises a rectangular frame 10 supporting two or more rectangular covers 11, both the frame and the covers being formed from cast iron. The centre portions of the covers may be formed with recessed areas 12 to receive a concrete filling, indicated at 13.

The frame 10 may be integrally formed in one piece or may be formed from elongate side members and end members secured together. A side frame member is indicated generally at 14 in the drawings. The end frame members, not shown, are of similar construction.

As best seen in FIGS. 1 and 2, each side frame member 14 is generally of inverted U-shape in cross-section the outer and inner flanges of the U being indicated at 15 and 16 respectively. A horizontal flange 17 projects inwardly from the lower edge of the inner flange 16 and an upstanding peripheral wall 18 extends upwardly from the top web of the side member.

Disposed inwardly adjacent the peripheral wall 18 of the side member is a peripheral sealing surface formed with two upstanding ridges 19 which extend longitudinally of the side member 14. The sealing surface, and the ridges 19 formed thereon, extend continuously around the side and end members of the frame, as does also the wall 18.

At the junction between the two covers 11 to be supported by the frame, a removable beam 20 extends across the frame from one side member 14 to the other (not shown). The ends of the support beam are received in recesses 22 in projections 23 formed on the inner flange 16 of the side member.

The opposite sides of projections 23 on the side frame member 14 are formed with upwardly and oppositely inclined support faces 29. Similar support faces are formed on further projections (not shown) at spaced intervals along the side member 14, and on one side only of projections adjacent the corners of the frame.

The inclined support surfaces 29 on the frame member cooperate with corresponding inclined surfaces on downwardly extending projections 30 (see FIG. 2) at the sides of the covers 11. The mating inclined support surfaces serve to support the covers on the frame with a wedging action, thus ensuring that the covers do not rock when in position on the frame. It will be appreciated that the required number and disposition of the projections 23 and 30 will depend on the size and number of the covers to be supported on the frame.

As best seen in FIGS. 2 and 3, the upper part of each cover 11 is formed with an outwardly projecting peripheral flange 31 which is of such a width that its outer edge is closely adjacent, but spaced from, the upstanding peripheral wall 18 on the side frame member. The upper surface of the cover 11 is substantially flush with the upper edge of the wall 18.

The under surface of the peripheral flange 31 is formed with two parallel longitudinal grooves 32 which define between them a downwardly projecting ridge 33 which extends continuously around the periphery of the cover. The depth of the flange 31, and the location of the inclined support surfaces 29 and 30, are such that when the support surfaces are engaged to support each cover 11 on the frame, the ridge 33 on the underside of the flange 31 on the cover projects downwardly between the upstanding ridges 19 on the side frame member, as shown in FIG. 2.

Before the covers are fitted to the frame, the ridges 19 on the side and end frame members and the underside of the flange 31 are smeared with sealing compound, such as grease, to fill the grooves between the ridges.

The described arrangement provides an effective gas, air and water tight seal around the periphery of the covers in a cover and frame assembly, while at the same time ensuring that the covers are secured against rocking movement. This is achieved using "as cast" components without the necessity of any machining of the components.

The inverted U-section of the side and end frame members assists in providing a firm fixing of the frame in a surface, since when the frame is concreted in, the concrete is forced into the inverted channel to provide a firm support structure. To facilitate the passage of concrete into the interior of the inverted U-section, the outer flange 15 of the U is formed along its length with apertures 37, and with cut-outs 38 along its lower edge so that the concrete can flow into the interior of the frame member through the apertures and cut-outs. The apertures 37 and cut-outs 38 constitute a major portion of the area of the outer flange of the frame member so that the portions of the flange between the apertures and cut-outs, as indicated at 39 in FIG. 3, in effect form tangs which act as holding down lugs for the frame.

Although the above described arrangement shows a number of covers mounted on a single frame, it will be appreciated that a similar arrangment may be employed for mounting a single cover on a single frame. In this case no support beams 20 are required since all four sides of the cover are supported on the side and end frame members.

Figure 5:
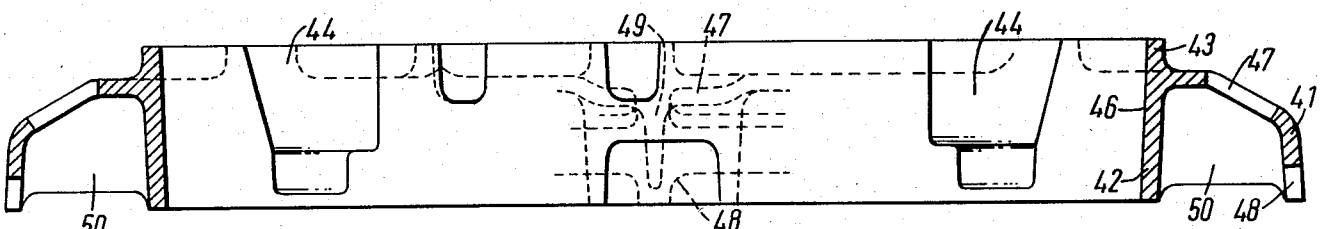
FIG. 5 is a section along the line 5—5 of FIG. 4.
Figure 4:
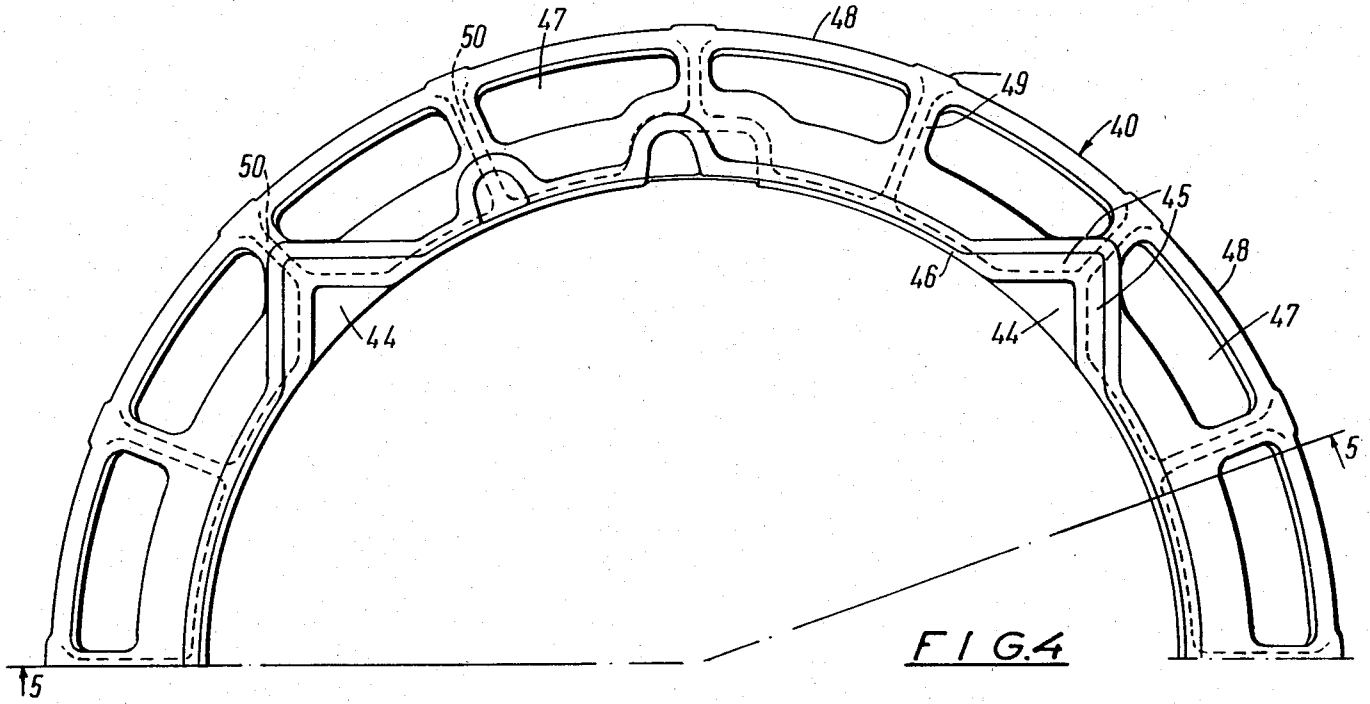
FIG. 4 is a plan view of part of an alternative form of frame incorporating the invention.

Although the invention has been described in relation to rectangular covers and frames, it will be appreciated that it is also applicable to circular covers and frames, as well as to other shapes, and FIGS. 4 and 5 show a circular frame incorporating the invention.

Referring to FIGS. 4 and 5, the circular manhole frame 40 is cast in one piece and, as best seen in FIG. 5, is generally of inverted U-shape in cross-section, the outer and inner flanges of the U being indicated at 41 and 42 respectively.

The inner flange 42 has an upward extension 43 and slopes slightly outwardly as it extends upwardly.

Equally spaced around the inner periphery of the frame 40 are four generally triangular recesses 44 having sloping side walls 45. As best seen in FIG. 4, the sloping side walls 45 of the recesses lie on the sides of a square which intersects the inner periphery of the frame. A circular cover (not shown) fits into the frame, and is formed with four equally spaced projecting triangular "ears" around its outer periphery, the ears being received in the recesses 44 and thus locating and supporting the cover in the frame. The cover is also provided with a peripheral sloping wall which engages the inner sloping wall 46 on the frame 40.

As in the previously described arrangement, the inverted U-section of the frame 40 provides a firm fixing for the frame since concrete enters and fills the inverted channel to provide a firm support structure. To facilitate the passage of concrete into the interior of the inverted U-section, the outer flange 41 of the U is formed along its length with apertures 47, and with cut-outs 48 along its lower edge so that the concrete can flow into the interior of the frame member through the apertures and cut-outs. The apertures 47 and cut-outs 48 constitute a major portion of the area of the outer flange 41 so that the portions of the flange between the apertures and cut-outs, as indicated at 49 in FIG. 4, in effect form tangs which act as holding down lugs for the frame.

In an alternative form (not shown) of the frame shown in FIGS. 4 and 5, the triangular ears on the cover, which engage within the recesses 44, are formed on the underside of the cover instead of projecting from the periphery of the cover, and the frame is suitably rebated between the recesses 44 to receive the circular periphery of the cover. In other words, the circular junction line between the cover and frame is located radially outwardly of the recesses 44, instead of radially inwardly as in the arrangement shown in the drawings.

In any of the arrangements described above, the inverted U-shape portions of the frame may be divided into cells by integrally cast partitions extending transversely at intervals along the periphery of the frame. Such partitions are indicated at 50 in FIGS. 4 and 5.

I claim:

1. A cast iron frame, for a manhole/access cover and frame assembly, comprising outer peripheral portions which are generally of inverted U-shape in cross-section so as to provide inner and outer downwardly extending limbs, the outer limb of the U-shape being formed with a plurality of apertures which open in a direction away from the vertical and which constitute a major portion of the area of said outer limb so that the portions of the limb between the apertures form tangs which act as holding down lugs for the frame.

2. A frame according to claim 1, wherein the lower edge of the inner limb of the inverted U-section is formed with an inwardly projecting, substantially horizontal flange.

3. A frame according to claim 1, wherein the frame comprises a number of separately formed frame members secured together end-to-end.

4. A frame according to claim 1, wherein the frame is integrally formed in one piece.

* * * * *